United States Patent [19]

Fernandez et al.

[11] 4,413,822

[45] Nov. 8, 1983

[54] ELASTIC CORE COMPOSITE STRUCTURE AND METHOD OF MAKING SAME

[75] Inventors: David Fernandez; Helena J. Fernandez, both of Camarillo, Calif.

[73] Assignee: American Sports Equipment, Camarillo, Calif.

[21] Appl. No.: 288,999

[22] Filed: Jul. 31, 1981

[51] Int. Cl.[3] ..... A63B 49/10

[52] U.S. Cl. ..... 273/73 C; 264/45.3; 264/46.6; 264/54; 273/DIG. 5

[58] Field of Search ..... 273/73 R, 73 C, 73 F, 273/DIG. 5; 264/45.3, 45.5, 46.6, 54

[56] References Cited

U.S. PATENT DOCUMENTS

| | | | |
|---|---|---|---|
| 3,373,123 | 3/1968 | Brice | 273/DIG. 5 UX |
| 3,930,920 | 1/1976 | Kicherer | 156/156 |
| 4,046,846 | 9/1977 | Fujimori | 264/45.3 |
| 4,061,520 | 12/1977 | Cecka et al. | 156/245 |
| 4,070,020 | 1/1978 | Dano | 273/73 F |
| 4,070,021 | 1/1978 | Cecka et al. | 273/73 F |
| 4,114,880 | 9/1978 | Cecka | 273/73 G |
| 4,294,787 | 10/1981 | Lo | 273/73 FX |

*Primary Examiner*—Anton O. Oechsle

*Attorney, Agent, or Firm*—Poms, Smith, Lande & Rose

[57] ABSTRACT

A tubular frame structure adapted for use as a tennis racket which includes an elastic polymer core which is bonded to and surrounded by a rigid shell of graphite composite. The elastic polymer core is a flexible vinyl foam prepared from plasticized polyvinyl chloride in which a suitable blowing agent is dispersed. A method for preparing the racket structure is disclosed.

The elastic polymer core provides a particularly desirable core material which does not degrade or breakdown during prolonged use and provides enhanced racket shock and vibration absorption, and, most importantly, the means to obtain the desirable variable density characteristics at the desired locations within the structure of racquet without a corresponding reduction in structural capability.

9 Claims, 8 Drawing Figures

ELASTIC CORE COMPOSITE STRUCTURE AND METHOD OF MAKING SAME

BACKGROUND OF THE INVENTION

The present invention relates generally to high strength, low weight structures comprising an amorphous core or filler material surrounded and fused to a shell composed of resin-coated high strength composite filaments or fibers. More specifically, the present invention relates to a lightweight, high strength and stiff tennis racket having improved energy absorption characteristics, structural endurance and easily controlled mass distribution for specific applications.

There is presently a wide variety of tennis rackets available to today's tennis player. These tennis rackets are made from various different materials and are available in numerous different sizes, weights, and configurations.

One of the more popular tennis frames developed recently is based on the use of resin-coated composite filamentary materials such as graphite fiber, glass fiber, boron filaments, kevlar filaments or any combinations thereof. By far, the most popular composite racket is made from resin impregnated graphite fibers.

Graphite fiber composite materials were originally developed for aerospace applications in high performance aircraft and missile structures. Due to the inherent lightweight and high strength of graphite composites, they were also found especially well suited for use in sports equipment. As a result, graphite composites have been widely used in the production of lightweight, high strength and high performance tennis racket frames. When cured at elevated temperatures, the resin-coated graphite fibers form a high strength, rigid and lightweight structure which is particularly well suited for providing a high performance tennis racket.

Basically, tennis frames made from graphite composites include a tubular rigid composite frame structure or shell. The hollow core present in such a tubular frame structure is typically filled with a variety of core materials. The properties and configurations of both the rigid composite shell and core structure are important in providing a tennis racket with desired performance qualities. Graphite fibers of various different sizes impregnated with a wide variety of resin materials are commercially available. Many of these commercially available graphite composite materials have been used to provide entirely adequate rigid tubular tennis frame structures. With regard to the core structure, however, there has yet to be developed a core material or structure which has been found entirely adequate for use in the high performance graphite tennis rackets.

An optimum core structure should provide good energy absorption characteristics to reduce shock and vibration which otherwise would be present in a hollow tubular frame structure during ball impact. Further, the mass distribution of the core material throughout the tennis frame tubular structure should be easily varied. This variable mass distribution allows fine tuning or balancing of mass between the frame head and handle to enhance desired performance characteristics. The core structure should also be resistant to degradation and decomposition due to shock and vibration over long periods of racket use. In addition, it is desirable that the core material fuse or otherwise bond to the interior of the rigid composite shell to insure a solid vibration-free feel during racket use.

Another important property desirable in an optimum core material is the ability of the core material to expand of otherwise provide internal pressurization during molding of the graphite racket. Typical production of graphite composite/core tennis rackets involves surrounding the core with graphite fibers in specific orientations. The graphite fiber/core structure is then molded at elevated temperatures to provide the desired structural shape. The internal pressure for insuring that the rigid graphite shell is molded properly is typically and most conveniently provided by the core itself. The core material's ability to expand or otherwise generate internal pressure is therefore an important quality which is desirable in commercial processes for producing such graphite composite tennis rackets.

Foamable or intumescent resinous compositions have been utilized as suitable core materials. Foamable materials are desirable since they provide the necessary internal pressure during the molding operation. Typically, the resin compositions are mixed with various additives such as barium sulfate, chopped cork, glass, asbestos, fibers, mica flakes and the like. These additives are used for various reasons ranging from control of density within the core to low density fillers to produce a lighter weight racket. These resinous core compositions typically include epoxy or phenolic resins. The core characteristics range from stiff, hard and brittle compositions, to those compositions having consistencies of firm putty or molding clay. Although many of the core materials presently being used in graphite frames have been found adequate for their intended purpose, problems have been experienced with premature deterioration and crumbling of the core material resulting in loss thereof through stringing holes or other openings in the racket frame.

Although the core structures and materials presently being utilized in composite tennis frame structures are adequate for their intended purpose, none have been found entirely adequate in providing a core structure which optimizes all of the desirable core characteristics or qualities discussed above. It is therefore desirable to provide a core which not only provides internal pressure for molding the rigid composite shell but also allows covenient mass distribution throughout the tubular structure, enhanced absorption of racket shock and vibration along with increased resistance to core degradation or breakdown due to prolonged shock and vibration.

SUMMARY OF THE INVENTION

In accordance with the present invention, a composite structure having a core with all of the desirable core characteristics mentioned above is provided.

The present invention is based upon a tubular frame adapted for use as a tennis racket which includes an elastic polymer core which is bonded to and surrounded by the rigid composite shell. The elastic polymer core is preferably a flexible vinyl foam which is most preferably made from a plasticized polyvinyl chloride in which a suitable blowing agent is dispersed. The elastic polymer core in accordance with the present invention does not degrade or breakdown during prolonged use and provides enhanced racket shock and vibration absorption.

A method for preparing a racket structure in accordance with the present invention is disclosed. The method involves preparing a core precursor made from a plasticized vinyl polymer having a suitable amount of heat activated blowing agent dispersed therein. The precursor core is then wrapped or otherwise surrounded by resin coated composite fibers. The wrapped core precursor is then placed within a suitably shaped mold. The mold is heated to curing temperatures for the composite fibers. At the curing temperatures, the chemical blowing agent releases gas to provide the internal pressure necessary to force the composite fibers against the mold to form the desired composite structure shell shape. In addition, the foaming action of the blowing agent produces an improved flexible foam core which is bonded to the composite shell.

As a particular feature of the present invention, the core precursor is made from thin films of polyvinyl chloride. Blowing agent, preferably in powdered form, is applied to the surface of the polyvinyl chloride film. The polyvinyl chloride film is then spirally wrapped or otherwise rolled into a tubular structure containing numerous spiral layers. This spiral wrapping of the polyvinyl chloride films conveniently disperses the blowing agent throughout the core precursor structure. This particular spiral wrapping arrangement provides an especially preferred core structure in accordance with the present invention.

A particularly preferred blowing agent is azobisisobutyronitrile (AZDN). AZDN decomposes at the curing temperatures for graphite composites and further, it is believed that during decomposition, the AZDN generates free radicals which function as a graft or polymerization initiator as well as a foaming agent to provide added cross-linking in the vinyl compounds. This is believed to provide an especially suitable core material.

As a further feature in accordance with the present invention, the number of layers present in the core precursor may be varied at different locations to provide a convenient means for varying the mass distribution throughout the tubular racket structure. This provides an especially desirable means for distributing mass between the racket head and racket handle areas in order to custom balance rackets to individual requirements.

The above discussed and many other features and attendant advantages of the present invention will become apparent as the invention becomes better understood by reference to the following detailed description when considered in conjunction with the accompanying drawings.

BRIEF DESCRIPTION OF THE DRAWINGS

FIG. 7 is a sectional view of the uncured tubular/-composite shell structure in place within an exemplary mold.

DETAILED DESCRIPTION OF THE INVENTION

Figure 1:
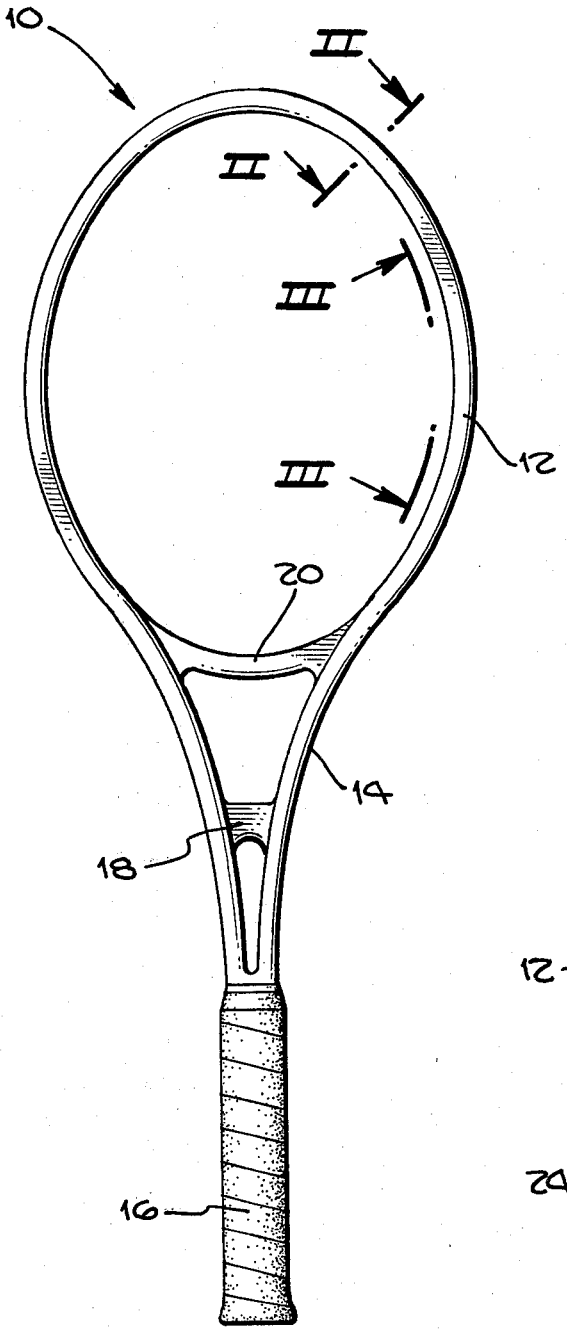
FIG. 1 is a general view of an exemplary tubular frame tennis racket in accordance with the present invention.

The tubular frame structure of the present invention may be utilized in any number of devices or apparatus where a lightweight, strong and rigid structure is desired. However, it is particularly preferred that the tubular frame structure in accordance with the present invention be utilized in producing a high performance tennis racket frame as shown generally at 10 in FIG. 1.

The tennis racket frame 10 includes a head portion 12, neck portion 14 and handle 16. The neck portion 14 includes lower cross brace 18. An upper cross brace member 20 provides strength and stiffness to the neck and head portions while at the same time providing a member through which racket strings may be attached.

Figure 3:
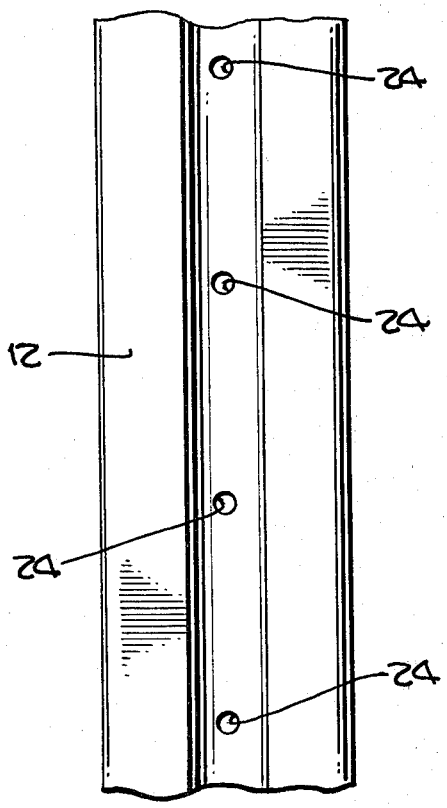
FIG. 3 is a view of the tubular frame structure of FIG. 1 taken in the III—III plane.

As shown in FIG. 3, the head portion 12 includes a radial groove 22 through which a plurality of holes 24 are drilled or otherwise provided to allow rigging of the tennis racket strings to the head portion 12 as is conventionally known.

Figure 2:
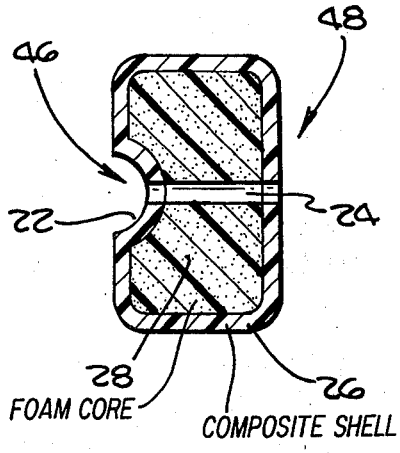

Referring to FIG. 2, the tubular frame structure includes a rigid outer shell 26 made from conventional resin impregnated graphite fibers. The tubular structure further includes a core 28. The core 28 is a flexible vinyl foam which will be discussed in detail later.

The composite material which forms the rigid shell 26 may be made from any of the conventional resin coated composite filamentary materials such as graphite fiber, glass fiber, boron filaments, kevlar filaments or any combination of these filamentary materials. The preferred composite material is graphite fibers either in woven sheets or filamentary form. Particularly well-suited are graphite fiber sheets having a resinous binder material impregnated therein. The resinous binder may be any of the well-known thermoplastic or thermosetting resins conventionally utilized in graphite fiber compositions. It is preferred that thermosetting resins such as phenolic resins, cross-linked polyesters and epoxy resins be used. A particularly preferred graphite fiber sheet composition can be constructed from Celion grade 6000 or Celion grade 12000 which is available from the Celanese Corp. and marketed under the name of Celion Graphite Fiber.

For tennis racket frame construction, the graphite fibers are preferably of medium modulus of elasticity. The modulus of these fibers ranges generally from about 30 million to about 40 million pounds per square inch. Although the diameter of the graphite filament may vary, it is preferred that they have an extremely fine diameter on the order of about 0.0003 inch. When an exceptionally high strength and stiffness rigid shell 26 is desired, graphite fibers having a high modulus (i.e. 50 million to about 60 million pounds per square inch) may be utilized. The orientation of the graphite fibers in the rigid shell 26 is preferably a wrapping configuration with the fibers alternating between +45 degrees and −45 degrees ralative the length of the tubular structure. Although any number of layers may be utilized, it has been found for tennis racket applications that three layers of graphite fiber sheets provides the necessary combination of strength, light weight and performance. A preferred fiber orientation would include one layer with the fibers being inline with the length axis of the cylinder, another layer with the longitudinal axis of the fibers being located at 45 degrees to the longitudinal axis of the tubular structure and a third layer with the fibers located perpendicular to the second fiber layer. This orientation of fibers achieves desirable strength characteristics while maintaining lightweight and other desirable performance characteristics. The exact orientation and number of fibrous layers can be tailored to specific requirements of torsional stiffness, bending stiffness and rim stiffness to provide a wide variety of suitable light weight strong shell structures.

An important aspect of the present invention is the use of a flexible vinyl foam as the core 28. Preferably, the core should be made from a flexible vinyl foam. Although polymers of vinyl chloride are preferred, any of the common vinyl polymers and copolymers may be used. For example, polymers and copolymers of vinyl acetate and vinylidene chloride may be used. Other polymers may also be used so long as they are capable of providing a suitable elastic or flexible foam when heated with blowing agents at the temperatures of graphite composite curing. A suitable elastic foam should have an elongation modulus of 300 to 400 percent as measured by ASTM test No. 0882067. The foam should have a tensile strength of between 3000 and 5000 psi and should have an expansion of 100 to 200 percent when heated. Further the elastic foam should desirably bond to the graphite composite to provide an integral frame structure. Polyvinyl chloride is one of the world's largest-volume thermoplastics. Polyvinyl chloride is resistant to oxidation by water, acid and alklyds and has good weathering properties.

Polyvinyl chloride is a versatile material which may be compounded to form products having a wide range of characteristics. Chemically, all polyvinyl chloride homopolymers contain about 56.8% chlorine with the balance being hydrocarbon. Three criteria which affect the processing and final characteristics of the polyvinyl chloride resins are molecular weight, particle size and particle configuration. These criteria may be varied so long as the final polyvinyl chloride foam is flexible. Further, in compounding polyvinyl chloride, important additives such as heat stabilizers, lubricants, plasticizers, impact modifiers, processing aids, fillers and pigments are also important. Stabilizers prevent thermal degradation during processing and are believed to also extend the service of life of finished products. Typical stabilizers are organo-metallic salts based on tin, lead, barium-cadmium, calcium and zinc.

Lubricants facilitate the melt flow of PVC compounds during processing. Waxes, fatty esters, and metallic soaps of fatty acids are commonly used. Lubricants are used mainly in rigid (i.e. unplasticized) PVC, but may be utilized in producing a flexible foam if desired.

Impact modifiers are used to improve the impact resistance of rigid PVC compounds and include such materials as chlorinated polyethylene, ABS, methyl methacrylate-butadiene-styrene and ethylene vinyl acetate copolymers. Desired clarity and weathering resistance are important factors in the choice of modifier.

Processing aids such as styrene-acrylonitrile, and methyl methacrylate copolymers, and alpha methyl styrene may also be used to enhance the formation of a homogeneous melt and increase its strength.

Fillers such as calcium carbonate are used primarily to lower the raw material cost of PVC compounds. Use of fillers is also optional.

Pigments, both organic and inorganic, are used to impart color, opacity, and weatherability.

As is apparent numerous different additives may be added to the PVC. The amounts and types of additives may be varied as desired so long as a flexible PVC foam results when processed in accordance with the present invention.

A final and important additive to PVC is the plasticizer. Plasticizers impart flexibility to PVC compounds. The amount of plasticizer determines the degree of flexibility, and the type(s) of plasticizer is chosen for the particular properties desired. The level of plasticizer may vary from 10 parts per hundred of resin (p.h.r.) in semirigid compounds to 100 p.h.r. in very soft compounds. Phthalate esters are most widely used with adipates, azelates, phosphates, epoxidized soy bean oils, etc. also used to obtain different properties on a cost performance basis. Such considerations as low migration, performance at temperature extremes, and flame retardance generally determine choice of plasticizer(s).

As with other additives, the amount and types of plasticizers may be varied so long as a flexible PVC foam is produced when heated in the mold. Rigid or semi-rigid foams are not preferred. The amounts of plasticizer should be between 15 parts per hundred PVC and 75 parts per hundred PVC. Preferrably the amount of plasticizer is about 25 parts per hundred PVC. Preferred plasticizers include CH-A and CH-10 available from Richold Corp. (Azusa, Calif.)

A particularly preferred polyvinyl chloride material is available from Goodyear Tire and Rubber Company under the tradename of Prime Film.

Although polyvinyl chloride is available in many various different forms such as a granular powder, it is preferred that the polyvinyl chloride be in the form of thin sheets having a thickness of between 1 and 15 thousandths of an inch. Since the core 28 in accordance with the present invention is a polyvinyl chloride foam, suitable means must be provided for foaming the polyvinyl chloride. Although any number of mechanical foaming agents such as gases or the like could be utilized, it is particularly preferred that chemical blowing agents be utilized. Although any number of foaming or blowing agents may be utilized so long as their decomposition temperature is in the curing range of the graphite composite epoxy resin it is particularly preferred that 2,2' azobisisobutyronitrile (AZDN) be utilized. AZDN has been employed in the manufacture of cellular vinyls from plastisols and other vinyl compositions. A particular advantage of using AZDN as the chemical foaming or blowing agent is the known generation of free radicals during decomposition. These free radicals are believed to function as a graft or polymerization initiator to induce cross-linking of the flexible vinyl. This is believed to provide an especially desirable flexible core material which is well-suited for use in tennis rackets. In addition to AZDN, other well-known azo foaming agents such as 1—1',Azobisformamide (ABFA) may be used.

Figure 4:
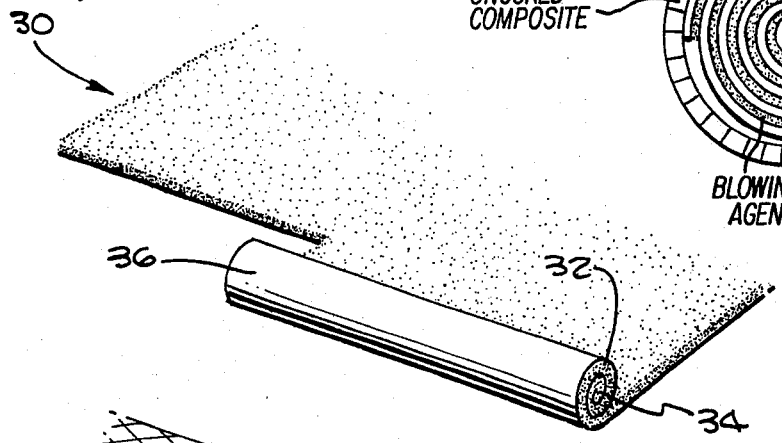
FIG. 4 is a perspective view of a preferred spirally wrapped core precursor.
Figure 6:
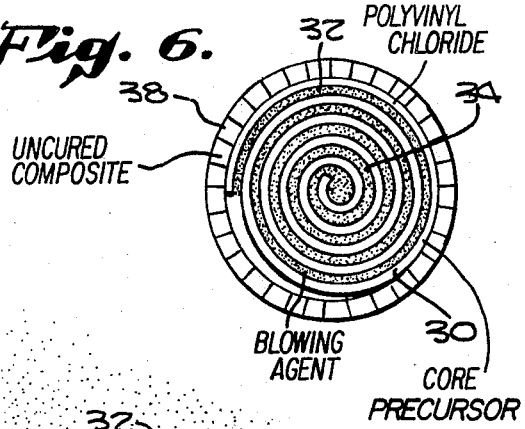
FIG. 6 is a sectional view of FIG. 5 taken in the VI—VI plane.

Preparation of the tubular frame structure involves three basic steps. The first two steps involve the preparation of the tubular core precursor followed by wrapping or surrounding of the core precursor with the uncured graphite fibers. As a final and third step, the fiber wrapped core precursor is placed within a suitable mold and heated to curing temperatures. A typical core precursor is shown generally at 30 in FIG. 4. The core precursor 30 includes a spirally wrapped sheet of plasticized polyvinyl chloride 32. It should be noted that the term plasticized polyvinyl chloride is used to denote any type of PVC having sufficient plasticizer to provide a flexible or elastic foam when processed according to the present invention. The spirally wrapped PVC 32 forms a tubular structure having numerous layers. The number of polyvinyl chloride layers will vary depending upon the thickness of the polyvinyl chloride sheet, the tightness of wrapping and the desired tubular core dimensions. The relatively large thickness of the PVC film and relatively few layers as shown in the figures is for demonstration purposes only, it being understood that in practice the spirally wrapped sheet 32 will have many more layers of spirally wrapped PVC with the PVC being much thinner than shown. Further, a plurality of sheets may be layered on top of each other with the layered sheets being rolled into a spiral tube. By varying the number of sheets, a convenient means for distributing mass at various locations in the frame structure is provided.

Although the blowing agent may be applied to the polyvinyl chloride in any manner, it is preferred that the blowing agent is applied to the surface of the polyvinyl chloride sheet prior to spiral wrapping thereof. In this way, layers of blowing agent 34 are provided dispersed throughout the spiral structure. It is particularly preferred that the majority of the blowing agent be distributed in layers closer to the center of the spirally wrapped PVC so that upon heating, the gas expands outward from the core center through the various layers.

As a particular feature of the present invention, extra layers of polyvinyl chloride sheet may be added to various spaced locations along the core precursor 30. An example of this is shown at 36 in FIG. 4 where an added layer of PVC is provided by cutting the PVC sheet as shown and rolling the sheet as shown. By varying the number of PVC layers at different spaced locations along the core precursor, it is possible to vary the density (i.e. mass) of the core precursor to thereby distribute weight as desired throughout the tennis racket structure 10.

Figure 5:
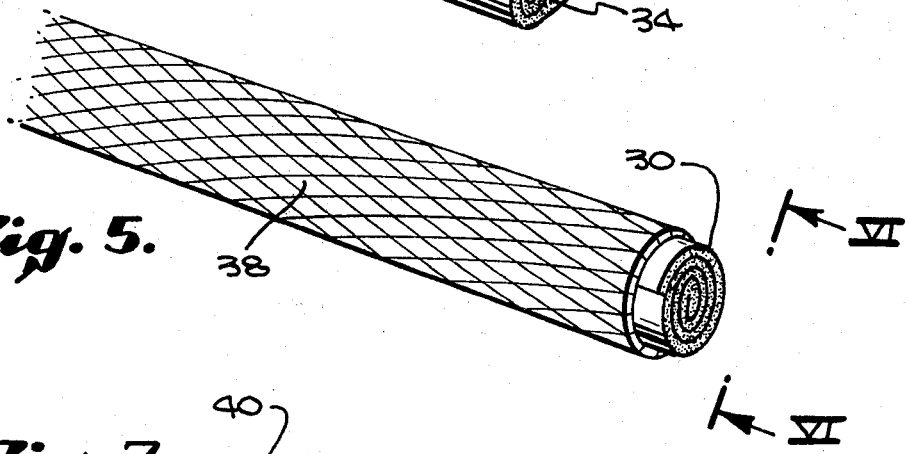
FIG. 5 is a view of a preferred core precursor being wrapped in or surrounded by resin impregnated composite fibers.

After the core precursor 30 has been prepared, it is wrapped or otherwise surrounded by the uncured graphite composite. Preferably, the graphite composite-fiber are formed by winding fibers around the core precusor to form woven tube. Such a fiber composite tube is shown at 38 in FIG. 5 having the core precursor 30 wrapped therein. This combined core precursor/-composite fiber structure is then ready to be molded according to conventional molding techniques. Alternatively, a woven graphite tube of appropriate size may be prepared and the core precursor inserted therein.

Figure 7:
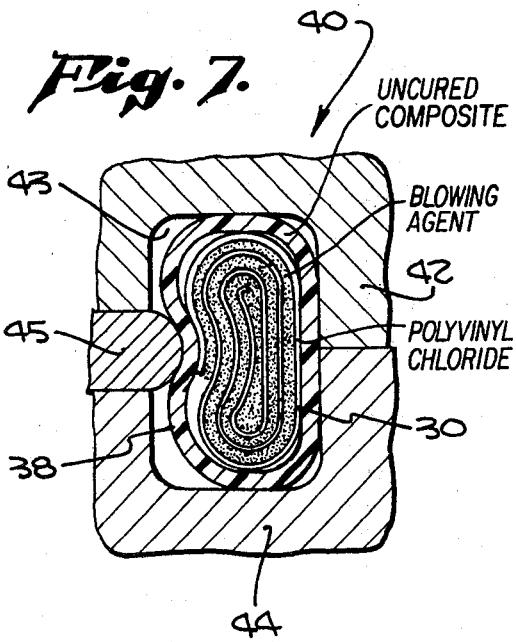
FIG. 7 is a cross-sectional view of the tubular frame structure taken in the II—II plane of FIG. 1.

As shown in FIG. 7, the uncured composite fiber shell and core precursor are inserted into mold 40. The mold includes an upper mold plate 42, middle mold plate 45 and lower mold plate 44. The mold plates 42, 44 and 45 are clamped togeher by hydraulic means, tie bars or other high strength clamps. The mold is then heated to the curing temperature of the graphite composite material. This temperature usually is between about 225 degrees F. to about 350 degrees F. At these temperatures, the blowing agent decomposes or otherwise undergoes a chemical reaction to produce the foaming gas within the mold cavity 43. The gas formation not only produces the flexible polyvinyl chloride form structure, but in addition provides the internal pressure necessary to force the composite fibers outward against the mold to form the desired rigid shell shape. The heating period may be varied depending upon the temperature used and the particular resins and polyvinyl chloride utilized. Typically however, the heating period will be in the range of ½ to 2 hours.

Figure 8:
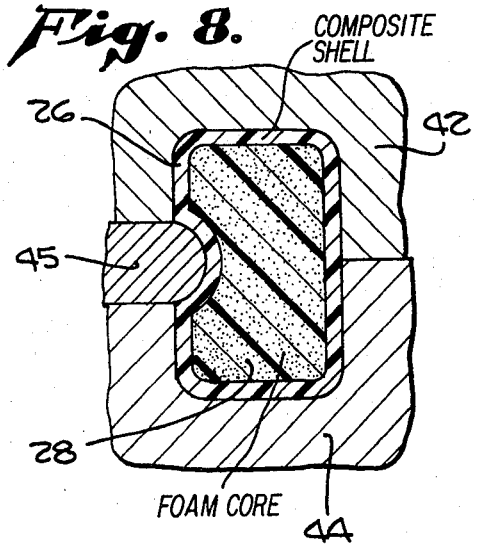
FIG. 8 is a sectional view showing the heat-cured tubular frame structure in accordance with the present invention after curing and molding in the exemplary mold.

Although the amount of blowing agent added to the polyvinyl cloride core precursor 30 is not critical, there should be sufficient blowing agent to provide the internal pressure necessary to adequately mold the composite layer. The required pressure is usually on the order of 50 to 150 psi. Preferably a slight excess of blowing agent is utilized. Typically, between 100 grams and 150 grams of blowing agent is utilized per kilogram of polyvinyl chloride material. The amount of blowing agent should be limited however so that the final expansion foam is between 100–200 percent. After suitable heating, the final frame structure is produced as shown in FIG. 8. The mold is then cooled with the completed frame structure being removed therefrom. The polyvinyl chloride during melting and expansion thereof to form the foam core bonds firmly to the graphite composite layer to provide an integral frame structure.

If desired, reinforcing strips of graphite fiber materials (not shown) may be placed on the left or right side of the tubular structure as shown in FIG. 2 at 46 and 48 respectively. These reinforcing strips are optional and may be added where extra rigidity and strength is desired especially around the string holes 24 where string tension and wear may require added strength.

Preferably the core precursor 40 and graphite tube 38 are approximately 60 inches long so that the assembled core precursor and uncured composite fiber can be laid as a continuous structure element within a standard size tennis racket mold. This allows single step molding of the racket. The actual size of an individual desired polyvinyl chloride sheet is approximately 60 inches by 12 inches with a thickness of approximately 0.003 of an inch. One or a number of sheets may be rolled or tightly wound about a small metallic mandrel in order to make spiral wrapping easy. The metallic mandrel is removed prior to curing.

The tennis racket constructed in accordance with the above described method produces a racket of substantially increased strength characteristics, increased stiffness, increased energy absorption, as well as being able to obtain the desirable variable density characteristics at the desired locations within the structure of the racket without a corresponding reduction in structure capability. As a result, maximum freedom in design is available to obtain specific flexural and tortional stiffness. In addition adequate rim stiffness is provided to maintain the shape of the frame during stringing and to support the high local stresses imposed by the strings.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein.

What is claimed is:

1. A tubular frame structure adapted for use as a tennis racket comprising an elastic polyvinyl foam core surrounded by a rigid composite shell, wherein said foam core is made by applying a foam effective amount of a heat activated blowing agent to the surface of a thin film of plasticized polyvinyl chloride to provide an activated film with blowing agent on at least one side thereof, spirally wrapping said activated film into a multi-layer core precursor prior to heating, said core precursor having said blowing agent dispersed between said layers, placing said core precursor within an uncured composite shell and heating said core precursor and uncured composite shell at a sufficient temperature and for a sufficient time to form said polyvinyl foam core and said rigid composite shell.

2. A tubular frame structure according to claim 1 wherein the number of layers of spirally wrapped activated film is varied longitudinally along said core precursor to provide an elastic polymer core having variable mass at spaced longitudinal locations within said tubular frame structure thereby providing means for varying the mass distribution of said tubular frame structure.

3. A tubular frame structure according to claim 1 wherein said heat activated foaming agent is azobisisobutyronitrile.

4. A tubular frame structure according to claim 1 wherein said thin film is from between about 0.001 inch and 0.015 inch thick.

5. A tubular frame structure according to claim 4 wherein said polyvinyl chloride includes between 15 parts per hundred and 75 parts per hundred plasticizer.

6. In a method for producing a composite tubular frame structure comprising a rigid outer shell and a core wherein a core precursor is surrounded by an uncured composite shell and placed in a mold whereupon heating of said mold, said core precursor expands to provide internal pressure necessary to shape said composite shell by forcing said shell against said mold, said shell curing to form said rigid outer shell and said expanded core precursor forming said core, wherein the improvement comprises:

providing a core precursor made from a thin sheet of flexible polyvinyl chloride and a suitable blowing agent, wherein said core precursor is prepared by spirally wrapping one or more of said thin sheets of said polyvinyl chloride having said blowing agent on at least one surface thereof, said spirally wrapped sheets forming a multi-layered tubular core precursor having blowing agent dispersed between said layers.

7. An improved method according to claim 6 wherein said blowing agent is azobisisobutyronitrile.

8. An improved method according to claim 6 wherein said mold is heated to temperatures of between about 225 degrees F. to 350 degrees F.

9. An improved method according to claim 6 wherein said spirally wrapped sheet includes different numbers of layers at spaced locations along said tubular core precursor to thereby provide a means for varying the mass distribution of said tubular frame structure at said spaced locations.

* * * * *